US006189299B1

(12) United States Patent
Brown et al.

(10) Patent No.: US 6,189,299 B1
(45) **Date of Patent: *Feb. 20, 2001**

(54) APPARATUS FOR COOLING AND PACKAGING BULK FRESH PRODUCTS

(75) Inventors: Richard S. Brown, Chualar; Michael V. Brown, Castroville, both of CA (US)

(73) Assignee: Fresh Express, INC, Salinas, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/037,927

(22) Filed: Mar. 10, 1998

(51) Int. Cl.[7] ..... B65B 31/00
(52) U.S. Cl. ..... 53/512; 53/89; 141/66
(58) Field of Search ..... 53/512, 175, 89, 53/90, 110, 86, 510; 141/66, 314; 426/410, 413, 395

(56) References Cited

U.S. PATENT DOCUMENTS

| | | | |
|---|---|---|---|
| 910,882 | 1/1909 | Truesdell . | |
| 1,661,602 | 3/1928 | Dary . | |
| 2,003,326 | 6/1935 | Wellman . | |
| 2,170,378 | 8/1939 | Orstrom . | |
| 2,214,944 | 9/1940 | Vogt . | |
| 2,294,668 | 9/1942 | Karas . | |
| 2,335,913 | 12/1943 | Buttery . | |
| 2,424,693 | 7/1947 | Jones . | |
| 2,611,709 | 9/1952 | Plagge . | |
| 2,627,862 | 2/1953 | Flusher . | |
| 2,815,621 | * 12/1957 | Carter | 53/512 X |
| 2,920,967 | 1/1960 | Heinemann . | |
| 2,925,210 | 2/1960 | Fallert . | |

(List continued on next page.)

FOREIGN PATENT DOCUMENTS

| | | |
|---|---|---|
| 1025786 | 2/1978 | (CA) . |
| 2842204 | 4/1980 | (DE) . |
| 025334 | 1/1988 | (EP) . |
| 402436 | 12/1933 | (GB) . |
| 764796 | 1/1957 | (GB) . |
| 1378140 | 12/1974 | (GB) . |
| 60-126032 | 7/1985 | (JP) . |

OTHER PUBLICATIONS

Wiley Encyclopedia of Packaging Technology J. Wiley & Sons, 1986 pp. 24–29, 66–81.
Packaging, Japan, Nov. 198, pp. 17–22.
Chemical Engineering, vol. 64.
Modern Packaging, Aug. 1941, pp. 44, 45.
"The King PAK" eight sided fiberboard IBC from Packaging Review, May 1980, 1 page.
The Wiley Encyclopedia of Packaging Technology (WFPT), John Wiley & Sons, 1986, p. 493.

*Primary Examiner*—Linda Johnson
(74) *Attorney, Agent, or Firm*—Patrick F. Bright

(57) ABSTRACT

Methods and apparatus for packaging whole or partially processed bulk, fresh products under modified atmosphere including placing such produce into bags or other containers for the produce, attaching to the opening at the top of each of the bags or containers a tube having an openable and closable lid, placing the bags or other containers with the tubes attached thereto inside a vacuum chamber, withdrawing air from the vacuum chamber from the bags or other containers until the oxygen concentration in the bags or other containers has reached a desired level, refilling the bags or other containers with one or more gases other than air while restoring the pressure inside the vacuum chamber and outside the bags or other containers at rates sufficient to minimize crushing or bruising of produce in the bags or other containers as the pressure in the vacuum chamber rises from the reduced level to a desired, ambient level.

4 Claims, 11 Drawing Sheets

U.S. PATENT DOCUMENTS

| | | | | |
|---|---|---|---|---|
| 2,955,940 | | 10/1960 | Williams . | |
| 2,967,777 | | 1/1961 | Grindrod . | |
| 3,055,568 | | 9/1962 | Zalkind . | |
| 3,128,934 | | 4/1964 | Jacke . | |
| 3,203,437 | | 8/1965 | Faust . | |
| 3,204,825 | | 9/1965 | Underwood . | |
| 3,220,157 | * | 11/1965 | Buchner | 53/512 X |
| 3,261,533 | | 7/1966 | Ripking . | |
| 3,407,078 | | 10/1968 | Schlichter . | |
| 3,419,400 | | 12/1968 | Hayhurst et al. . | |
| 3,450,542 | | 6/1969 | Badran . | |
| 3,473,589 | | 10/1969 | Gotz . | |
| 3,484,017 | | 12/1969 | O'Donnell . | |
| 3,521,806 | | 7/1970 | Esty . | |
| 3,715,860 | | 2/1973 | Esty . | |
| 3,747,614 | | 7/1973 | Buedingen . | |
| 3,939,287 | | 2/1976 | Orwig et al. . | |
| 3,945,558 | | 3/1976 | Elder . | |
| 3,957,179 | | 5/1976 | Bamburg et al. . | |
| 3,990,358 | | 11/1976 | Cade . | |
| 3,991,543 | * | 11/1976 | Shaw | 53/512 |
| 4,001,443 | | 1/1977 | Dave . | |
| 4,006,561 | | 2/1977 | Toma et al. . | |
| 4,039,350 | | 8/1977 | Bucy . | |
| 4,055,931 | | 11/1977 | Myers . | |
| 4,061,785 | | 12/1977 | Nishino et al. . | |
| 4,066,401 | | 1/1978 | Solomon . | |
| 4,079,152 | | 3/1978 | Bedrosian et al. . | |
| 4,089,417 | | 5/1978 | Osborne . | |
| 4,105,153 | | 8/1978 | Locke . | |
| 4,168,597 | | 9/1979 | Cayton . | |
| 4,209,538 | | 6/1980 | Woodruff . | |
| 4,224,347 | | 9/1980 | Woodruff . | |
| 4,241,558 | * | 12/1980 | Gidewell et al. | 53/512 X |
| 4,258,848 | | 3/1981 | Akao et al. . | |
| 4,268,555 | | 5/1981 | Kantz . | |
| 4,296,860 | | 10/1981 | Hsu et al. . | |
| 4,343,429 | | 8/1982 | Cherry . | |
| 4,411,921 | | 10/1983 | Woodruff . | |
| 4,422,466 | | 12/1983 | Schafer . | |
| 4,423,080 | | 12/1983 | Bedrosian et al. . | |
| 4,454,945 | | 6/1984 | Jabarin . | |
| 4,515,266 | | 5/1985 | Myers . | |
| 4,516,692 | | 5/1985 | Croley . | |
| 4,610,885 | | 9/1986 | Tait . | |
| 4,670,227 | * | 6/1987 | Smith | 53/512 |
| 4,702,408 | | 10/1987 | Powlenko . | |
| 4,744,199 | * | 5/1988 | Gannon | 53/512 X |
| 4,744,203 | * | 5/1988 | Brockwell et al. | 53/512 X |
| 4,756,417 | | 7/1988 | Teixeira . | |
| 4,759,642 | | 7/1988 | Van Erden et al. . | |
| 4,813,791 | | 3/1989 | Cullen et al. . | |
| 4,840,271 | | 6/1989 | Garwood . | |
| 4,863,287 | | 9/1989 | Marisk . | |
| 4,886,372 | | 12/1989 | Greengrass et al. . | |
| 4,909,014 | * | 3/1990 | Kobayashi | 53/86 |
| 4,930,906 | | 6/1990 | Hemphill . | |
| 4,962,777 | | 10/1990 | Bell . | |
| 4,963,287 | | 10/1990 | Hutchings et al. . | |
| 4,967,776 | | 11/1990 | Folmar . | |
| 5,044,776 | | 9/1991 | Schramer et al. . | |
| 5,078,509 | | 1/1992 | Center et al. . | |
| 5,093,080 | | 3/1992 | Keller . | |
| 5,121,589 | | 6/1992 | Ventura et al. . | |
| 5,226,972 | | 7/1993 | Bell . | |
| 5,290,580 | | 3/1994 | Floyd et al. . | |
| 5,316,778 | | 5/1994 | Hougham . | |
| 5,346,089 | | 9/1994 | Brown et al. . | |
| 5,354,569 | | 10/1994 | Brown et al. . | |
| 5,402,906 | | 4/1995 | Brown et al. . | |
| 5,421,250 | | 6/1995 | Beaumont . | |
| 5,437,731 | | 8/1995 | St. Martin . | |
| 5,522,410 | | 6/1996 | Meilleur . | |
| 5,640,643 | | 6/1997 | Hoitz et al. . | |
| 5,713,101 | | 2/1998 | Jackson . | |
| 5,727,690 | | 3/1998 | Hofmeister . | |
| 5,728,439 | | 3/1998 | Carlblom et al. . | |
| 5,885,002 | | 3/1999 | Reiss . | |
| 5,954,067 | | 9/1999 | Brown et al. . | |
| 6,041,797 | | 3/2000 | Casselman . | |

* cited by examiner

FIG. 10
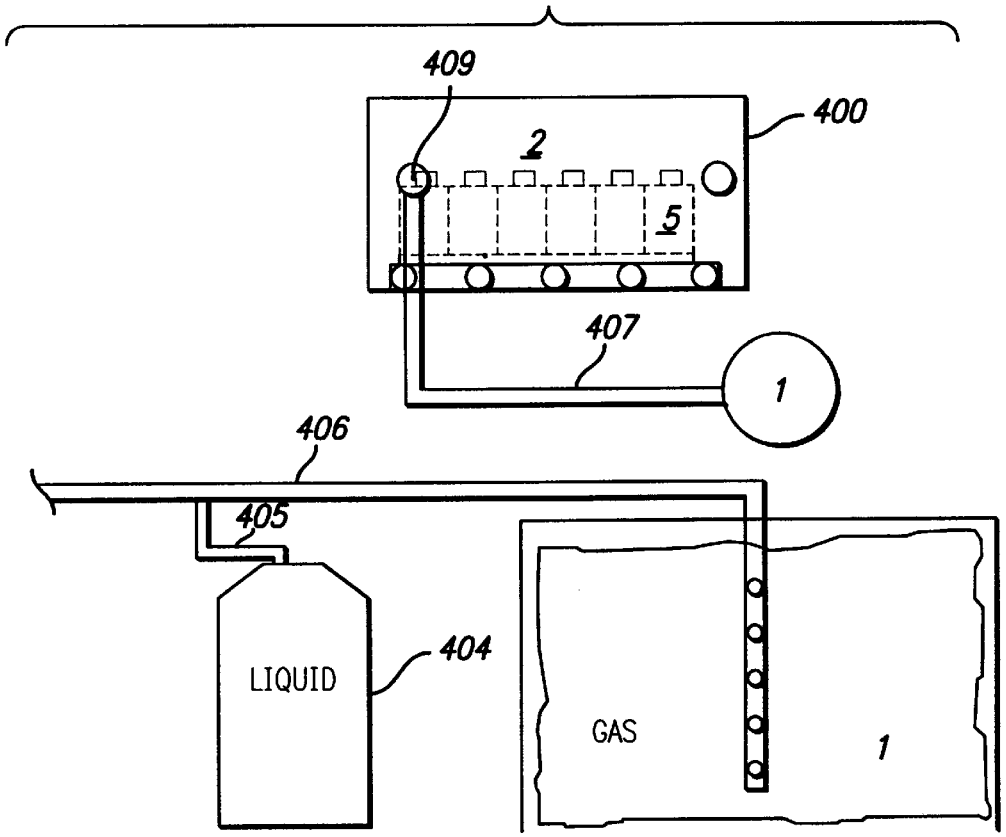
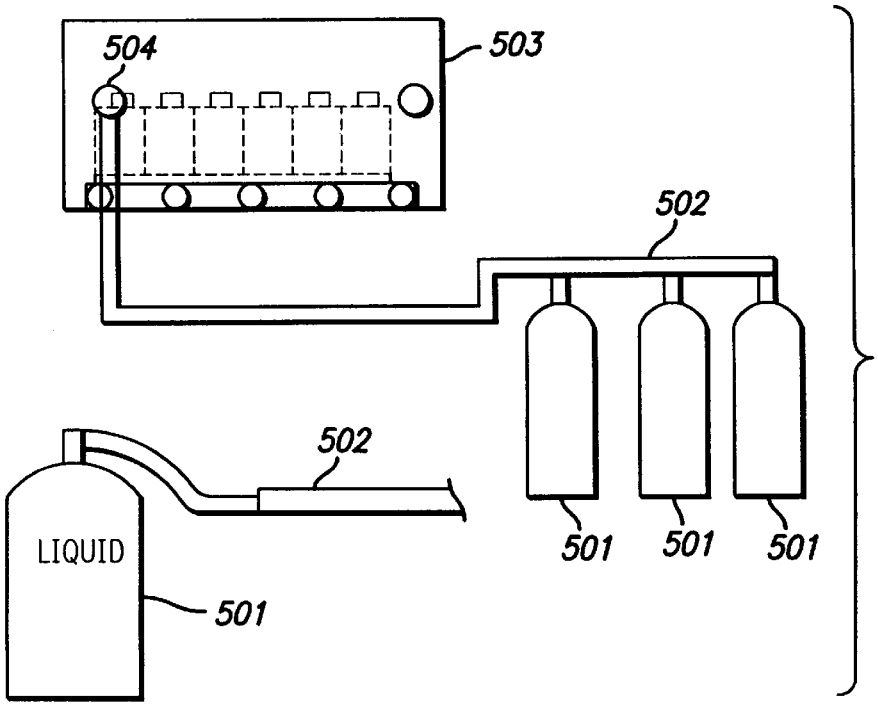
FIG. 11

APPARATUS FOR COOLING AND PACKAGING BULK FRESH PRODUCTS

This invention provides methods and apparatus for storing and for shipping whole or partially processed bulk fresh products under modified atmosphere that can extend the shelf life of the produce.

This invention provides methods and apparatus for gas flushing containers of fresh produce to form reduced oxygen environments in such containers without bruising the produce.

These methods and apparatus simultaneously evacuate air around and inside produce containers, minimizing pressure differentials which could cause crushing or bruising of the produce.

This invention is particularly directed to the prevention of bruising the produce while inhibiting enzymatic reactions resulting in oxidative browning and product breakdown.

This invention also provides means for obtaining specifically selected absolute pressures inside a vacuum chamber which establishes desired ratios of oxygen to inert gas inside one or more containers inside such a chamber.

The fresh produce industry continues to experience rapid growth in the production and distribution of packaged salads. The consumer is given the convenience of a fresh tasting salad, washed and ready to serve. Fresh produce is often packaged in flexible plastic bags that are designed to contain an oxygen reduced environment to prevent oxidation discoloration. More frequently, chopped, sliced or shredded produce, for example lettuce, is packaged in bags containing 10 pounds or less of product. Such fresh produce is first placed in a semi-permeable polyethylene or similar bag, and all or a portion of the air in the filled bag is withdrawn by squeezing or suctioning the bag.

Some packaging methods introduce an inert gas to replace air so removed. As air is removed from these bags, the cut pieces of produce are squeezed closely together, eliminating most of the voids where air would otherwise remain. These methods provide unacceptable results when the produce weight in the bag exceeds fifty pounds or more because of the resulting crushing and bruising of produce.

Atmospheric pressure at sea level exerts a force of approximately 14.7 pounds per square inch. To remove an adequate amount of ambient air from a large bag containing in excess of 100 pounds of fresh produce, the pressure inside the bag is often lowered to less than 3.7 pounds per square inch. The resulting differential pressure could equal or exceed 11 pounds of force on each square inch of bag surface area. For example, a whole lettuce head or like produce in contact with 16 square inches of bag surface receives a force equal to or greater than 176 pounds. This head is pressed against others inside the bag, transferring the forces to them, and causing additional crushing and bruising of the leaves and rib structure in the produce.

When a fresh produce container is rigid with airtight seals, our unique gas flushing methods and apparatus are particularly advantageous. When drawing a vacuum on such containers, the forces exerted by atmospheric pressure outside such containers can cause damage. For example, a rigid, airtight container shaped as a four foot cube experiences over 25,000 lbs of force on each side when the differential air pressure reaches 11 pounds per square inch, for a combined force of over 150,000 lbs. The construction requirements for such a container are too costly, and its empty weight too impractical for commercial use. By gas flushing such containers inside a vacuum chamber, the differential pressures are eliminated, simplifying the construction requirements for such containers.

Fresh produce has good shelf life if field heat is removed and the produce is held at a reduced temperature e.g., 33–38° F., but above freezing. Heads of lettuce deteriorate more rapidly in an oxygen-rich than in an oxygen-lean atmosphere. It is therefore desirable to store and transport cold lettuce in an environment low in oxygen concentration. When lettuce heads are partially processed in the field, either by removing the core and waste leaves, or by cutting a head into leaf pieces, the enzymatic reactions which cause deterioration accelerate. An uncut, intact lettuce head displays acceptable shelf life in environments with oxygen concentration above 5% by volume. A partially processed or fully processed lettuce head displays oxidative discoloration in a gaseous atmosphere containing above 5% oxygen by volume. Our methods can lower the oxygen concentration inside containers of lettuce heads to less than 4.0% by volume and above 0.5% oxygen without crushing or bruising the produce.

A fresh produce processor harvests and transports produce to a processing facility for chopping and slicing. In addition to transporting that portion of the fresh produce used in the salad, the processor is also hauling waste leaves, stems, cores, etc. Any damage to the fresh produce from harvesting, packing into bulk containers, or transporting to a processing facility may also result in discolored leaves from oxidation at damaged points. These leaves are also discarded as waste. Total waste may exceed 25% of the total weight in head lettuce and 40% of the total weight in romaine lettuce. The ability to ship bulk bins of produce to a processor with reduced waste offers substantial cost savings.

Our methods and apparatus improve reproducibility, and consistently form gaseous environments of desired oxygen concentration in containers for 50 pounds, 100 pounds or more of lettuce heads, other bulk leafy green produce, and other fruits and vegetables, while minimizing crushing and bruising.

Our methods and apparatus also speed produce packaging through batch processing of multiple containers, or large single containers.

Our methods of gas flushing take place inside vacuum chambers. One or more containers, e.g. bags of fresh produce are placed inside the chamber. A manifold including a tube with a hinged lid or butterfly valve on the top end, and a gas flush line attached to the side, is placed at the opening of each container. The opening atop the produce filled container, preferably a bag, is drawn tightly around the tube and affixed with a rubber band, string tie, elastic strap, ring clamp or similar device to seal the opening around the tube. Air is withdrawn from each bag and from the vacuum chamber by a vacuum pump. Air withdrawn from a container of produce flows through the tube, past an open, hinged lid, or open butterfly valve, and into the chamber for evacuation. Little difference in pressure exists between the inside and outside of the liner bag, minimizing crushing or bruising of produce in each bag during the vacuum cycle.

When the pressure inside the bag is at a desired, low level, corresponding for example to a desired, reduced oxygen concentration in the bag, the vacuum pump is stopped. Gravity, a solenoid actuator or an electric motor closes, and holds the lid closed on the top of each tube. Inert gas, e.g., nitrogen gas, is then introduced into each bag through a gas flush hose at a rate approximating the rate at which air is introduced into the vacuum chamber through a valve outside the produce bag. The produce bag is filled with a desired replacement gas until the pressure inside and outside the bag, but inside the vacuum chamber, is at or near the pressure outside the chamber. The chamber is then opened, the liner bag(s) is sealed below the tube with a tie wrap, wire tie, elastic band, heat seal, hermetic seal, or an equivalent closure, and the tube is removed.

Fresh produce, such as leafy vegetables, is vacuum cooled before storage and transport. Our methods can be combined with such cooling processes in which leafy vegetables like lettuce reach a desired temperature with both air and water vapor escaping a produce bag through a manifold tube. Such vacuum cooling may reduce the air pressure inside the vacuum chamber to a level of 4.5 to 5.0 mm Hg absolute. The chamber is then vented slightly to raise the pressure above 10 mm Hg absolute, or whatever absolute pressure value is necessary for the desired final oxygen level in the produce bag. Our methods can then follow. Alternatively, by performing our methods simultaneously with vacuum cooling, a second vacuum need not be drawn on the produce. Fresh produce which has first been cooled by any method can be placed in a vacuum chamber and gas flushed using our methods and apparatus.

As an alternative, bins of fresh fruits or vegetables can be placed into the vacuum chamber and the air withdrawn from the chamber with a vacuum pump or venturi. When the chamber air pressure is reduced to a desired level, e.g., to an absolute pressure of 4.5 to 5.0 mm Hg, the entire chamber and each produce bag in the chamber can be filled with nitrogen or other inert gas, restoring the chamber to ambient pressure. This alternative method is suitable for use with double stacked bins, double height bins, or other large vessels for holding and transporting fresh produce. When flushing the entire vacuum chamber, liner bags for produce may be used, but are not required. Bins or rigid containers may be constructed using built-in valves or membranes to release atmospheric air during the vacuum cycle, and to admit nitrogen or other inert/active gases during a chamber refilling cycle.

Because the inert/active gas sources may be low in water vapor, some embodiments of our methods introduce moisture with inert/active gas from bladders or bags outside the vacuum chamber, or another source, prior to or during the flushing cycle. Such moisture helps retain the freshness of the produce during subsequent storage and transit.

Our methods and apparatus are useful with several types of produce, fresh fruits and fresh vegetables. Enzyme concentration and enzymatic reactions resulting in oxidative browning vary among such products. These variations may be magnified when such products have been partially or fully processed, as by cutting, slicing, shredding or coring. Our methods and apparatus can advantageously establish specific, desired concentrations of oxygen in large containers for a large quantity of such products, and can accommodate varying crop conditions, and varying packaging mediums.

In some embodiments of our methods and apparatus, multiple inert gases may replace air inside produce containers. Multiple gasses may be pre-blended, or introduced concurrently or serially into the vacuum chamber through multiple sources. For example, some fruits, like strawberries, exhibit good shelf life when stored in nitrogen gas blended with carbon dioxide gas, and a low oxygen concentration. Our methods permit inflow of precisely blended inert and active gas mixtures into a produce container at desired oxygen concentrations.

These and other features and objects of the invention together with illustrative procedures for practicing the invention, will be more fully understood from the following detailed description of the accompanying drawings in which:

FIG. 1 shows diagrammatically an embodiment of the Inert Gas Flushing System (IGFS), particularly the vacuum chamber (end view) containing a transport shuttle loaded with Individual Bins of Fresh Produce (IBFP). The Gas Flush Manifold (GFM) is shown placed on the IBFP, connected to the IBFP's individually by each GFM tube at each tube ring. The GFM is shown connected to a hose, which is connected to the vacuum chamber through a gas flush valve. The gas flush system shows one feasible inert gas source, liquid nitrogen, supplied in gas form, from inert gas bladders.

FIG. 10 shows the IGFS of FIG. 1 using nitrogen gas delivered to a single high capacity bladder; nitrogen gas is delivered to this bladder from an expansion coil and accumulator connected to liquid nitrogen cylinders;

FIG. 11 shows the IGFS of FIG. 1 using nitrogen in gas form delivered from cylinders directly to intermediate feed lines and to the GFM on demand;

Figure 1:
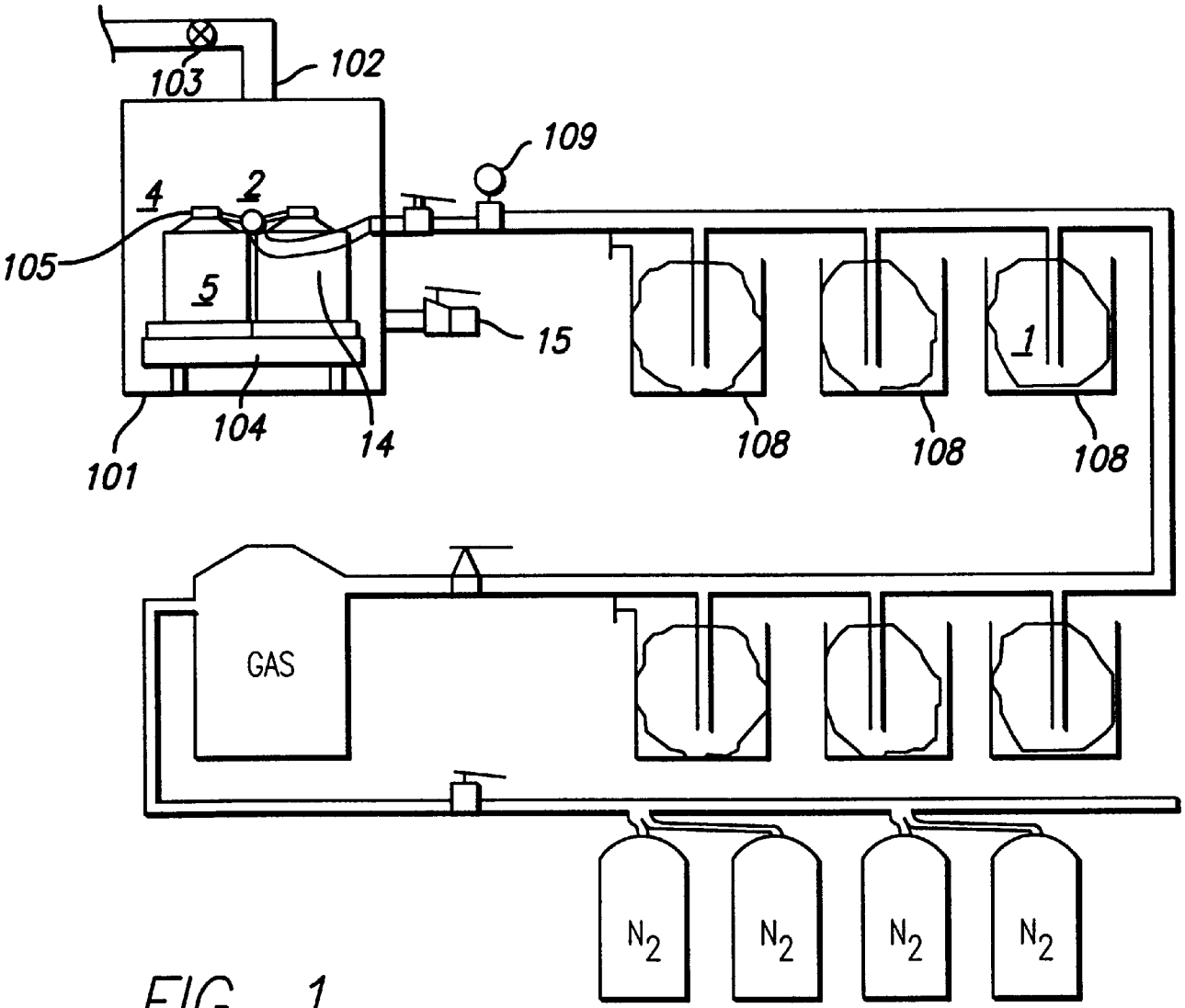
Figure 2:
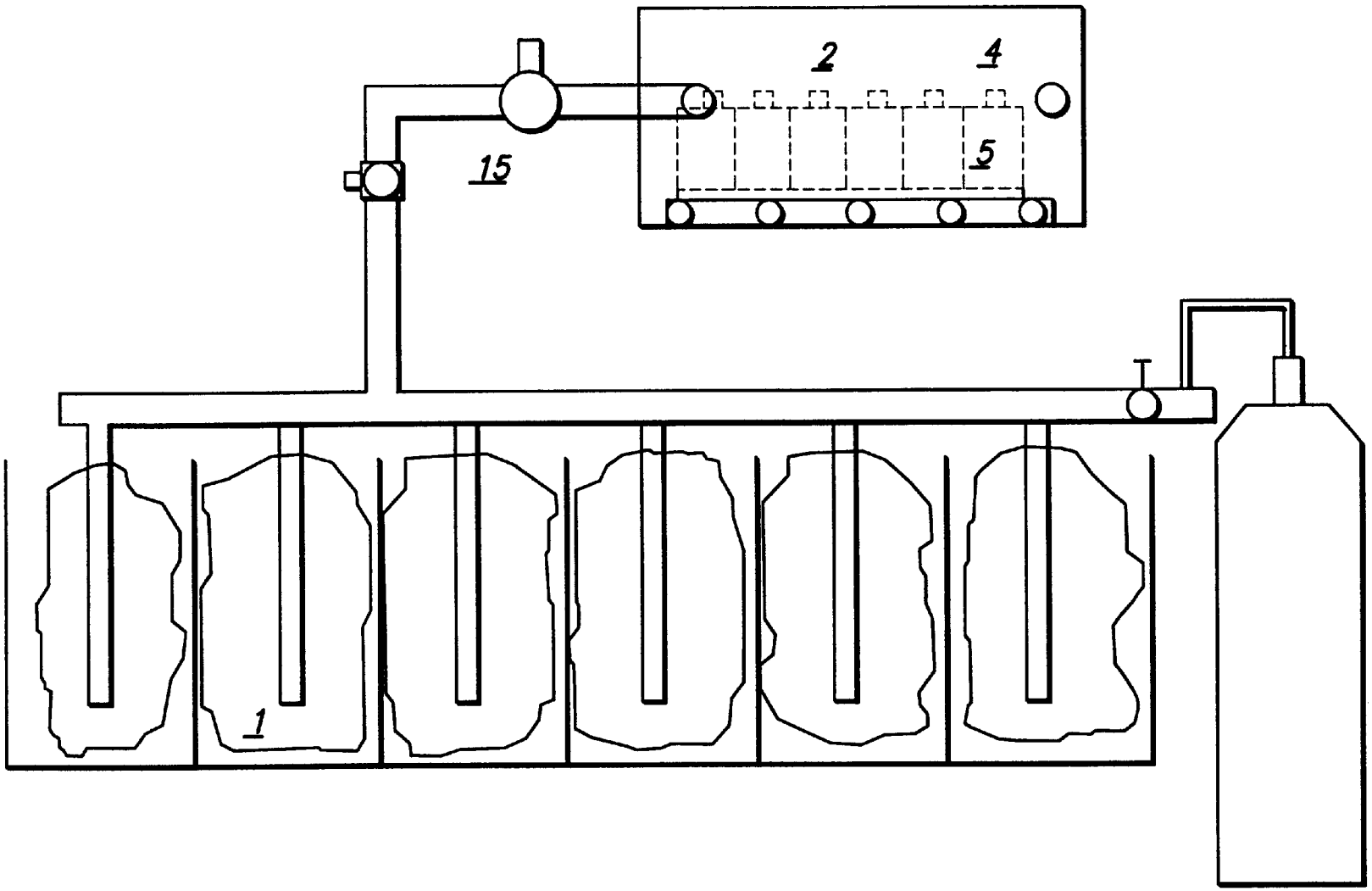
FIG. 2 shows additional details of the IGFS and its inert gas bladders and the exterior flow path from such bladders shown in FIG. 1.

FIG. 1 shows vacuum chamber 101 connected to vacuum line 102 at the top. Vacuum line 102 leads to a vacuum pump (not shown) through valve 103. Inside vacuum chamber 101 is platform 104 supporting a plurality of produce-filled bins, each containing a bag liner 5. Secured to the opening at the top of each bag liner 5 is tube 4 held sealingly to liner 5 by securing tie or strap 105. Each of tubes 4 is connected to nozzle 3 which in turn is connected to gas flush hose 7. Each of gas flush hoses 7 is connected to manifold 2. Manifold 2 provides the path by which air is withdrawn from each liner 5 by vacuum, and the path through which inert gas flows into liner 5 to replace withdrawn air. Manifold 2 includes main pipe 6 attached to each of the tubes 4. Manifold 2 is also connected, in the embodiment showing in FIG. 1, to bladders 1 outside vacuum chamber 101 through hoses 14 and valves 15.

Figure 3:
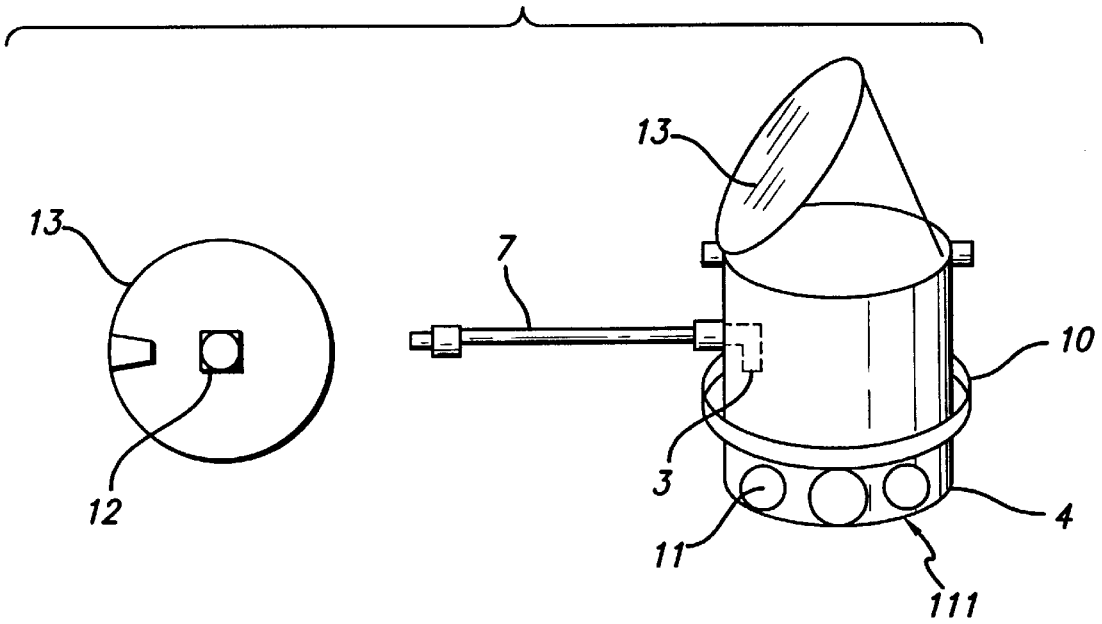
FIG. 3 shows a first embodiment of a gas flush manifold tube with a spring or gravity lid.
Figure 4:
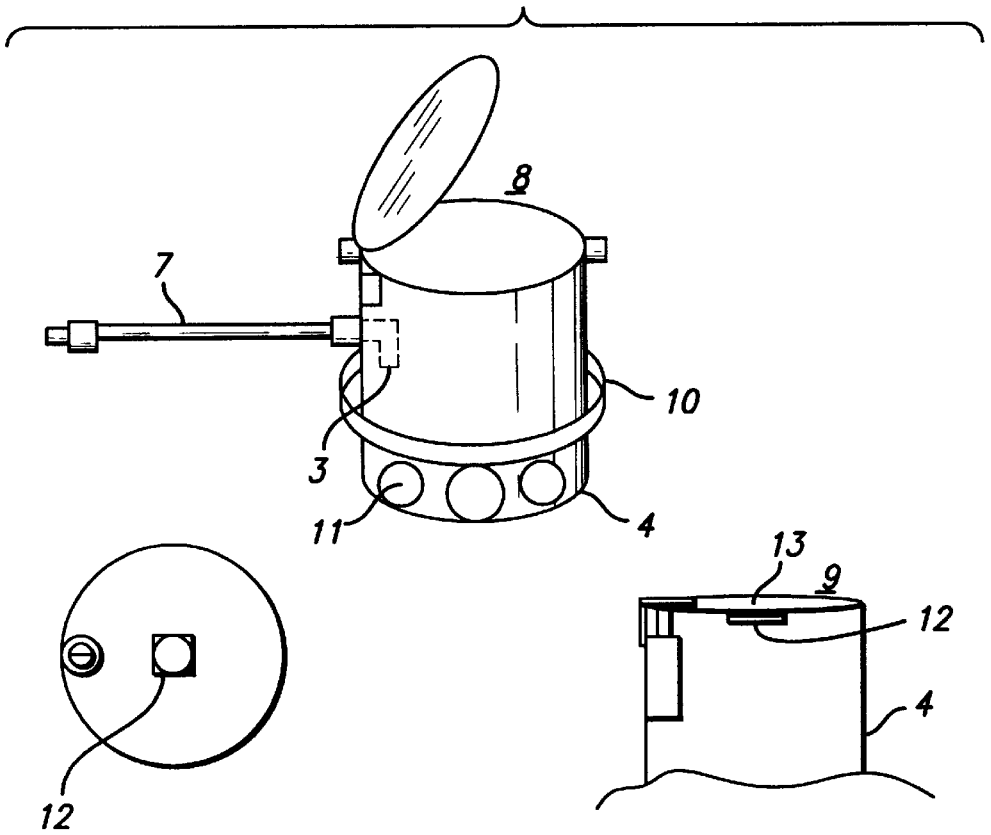
FIG. 4 shows a second embodiment of a gas flush manifold tube with a solenoid or motor controlled lid.
Figure 5:
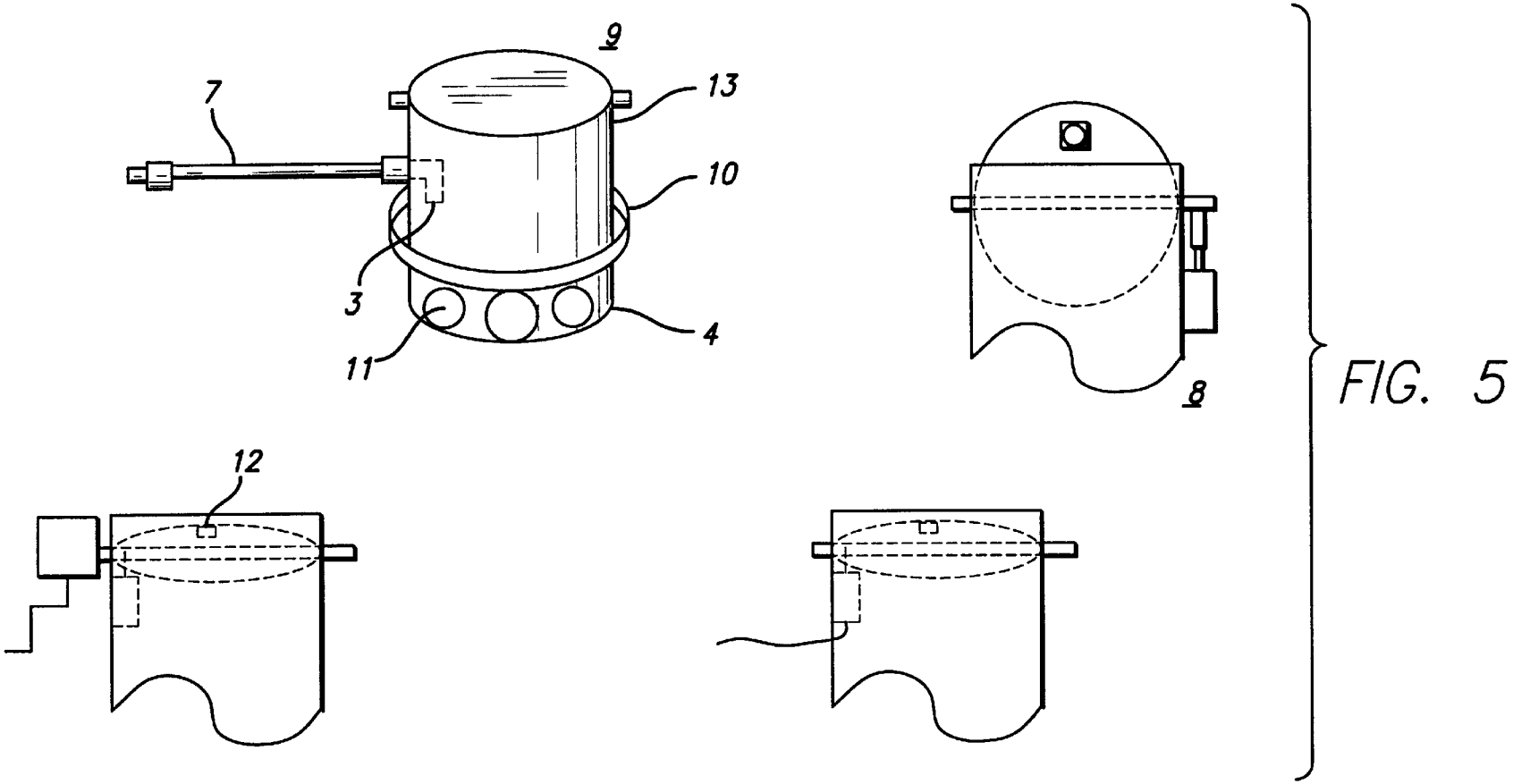
FIG. 5 shows a third embodiment of a gas flush manifold tube with a butterfly type valve or closure driven by either a solenoid or motor.

Several embodiments of tube 4 appear in FIGS. 3, 4, and 5. FIG. 3 shows side elevation and top plan views of a first embodiment of tube 4. Tube 4 includes, near opening 111 at the bottom, a series of steam or air vents 11. Around the exterior surface of tube 4 is tube ring 10. Tube ring 10, made of plastic or metal, provides a connection and holding point for attaching a liner bag 5 to tube 4. Ring 10 prevents liner bag 5 from separating from tube 4 by forming a slip resistant point wider in diameter than tube 4. Vent holes 11 allow air, water vapor, and other gases and liquids to flow freely from bag 5 during evacuation by vacuum, promoting fill evacuation of undesired gases from bag 5. Each tube 4 is attached to manifold 2 and to each of the individual containers of fresh produce 5. Flexible or rigid gas flush hose 7 connects tube 4 to manifold pipe 6. Liner bag 5 inside the container, which may be a bin or box, is fitted and secured around tube 4. See FIG. 7. Tube 4 then closes, either through gravity or mechanically or otherwise, allowing inert or active gases to replace the withdrawn air and to fill each individual liner bag 5 as the vacuum imposed on the bag is released and air or other gases return to vacuum chamber 101.

Outside vacuum chamber 101 is a plurality of large, gas-impermeable bags or bladders 1, 106 and 107. Each of these bladders is placed in its own enclosure 108 to minimize damage. Bags or bladders 1 are filled with a desired, predetermined concentration of inert or active gases, such as nitrogen, with the volume of gas in the bladders exceeding the volume needed to fill bag 5 after air has been withdrawn from bag 5. Atmospheric pressure exerted on bags 1 is equal to the atmospheric pressure of outside air, if any, entering vacuum chamber 101 through vacuum release valve 15. When inner gas flow control valve 109 is opened, atmospheric pressure is delivered to the gas flush nozzle inside vacuum chamber 101 and inside each liner bag 5 via manifold 2. The inert or other gases in bags 1 are then transferred from these bags into liner bags 5 by atmospheric pressure as chamber 101 refills with air, or otherwise returns to ambient pressure.

This apparatus precisely controls the percentages of oxygen by volume inside liner bags 5 by varying the absolute pressure of the vacuum drawn on each of bags 5, and the pressure at which refilling of liner bags 5 with inert or other desired gases begins. For example, an absolute pressure of 15 mm Hg yields an oxygen concentration in each liner bag of about 0.41% by volume. As another example, an absolute pressure of 36 mm Hg produces an oxygen concentration of about 1% by volume in each liner bag. By varying absolute pressure, these apparatus and methods permit the formation of oxygen concentrations in each liner bag 5 at precisely desired levels.

In preferred embodiments, the total combined circumferences of gas flush hoses 7 exceeds the circumference of vacuum release valve 109 for vacuum chamber 105. As a result, gas from bag 1 is delivered into liner bags 5 at a rate greater than the rate at which ambient air or other gases enters chamber 105 outside liner bags 5 so that liner bags 5 are filled with desired inert or active gases, not with undesired gases.

As FIGS. 3, 4 and 5 show, each of tubes 4 includes a pressure equalizing reed valve 12. Valve 12 prevents pressure differentials inside and outside liner bags 5 from damaging the produce inside bags 5. For example, if inert or other gases fail to flow to tubes 4 as the pressure inside vacuum chamber 105 rises, valve 12 opens to permit gases to enter bag 5, preventing damage to produce inside bag 5.

FIGS. 4 and 5 show alternative embodiments of tube 4. In the embodiment of FIG. 4, lid 8 is solenoid actuated, or is driven by an electric motor.

In the embodiment of FIG. 5, lid 9 is a butterfly valve that is motor driven or solenoid controlled.

As an alternative to the embodiment shown in FIG. 1, the methods and apparatus of this invention can deliver pressurized inert gas such as nitrogen directly to bags 5. Such gases flow through manifold 2 at a rate slightly higher than the rate outside air flows into the vacuum chamber 105 through the vacuum release valve.

As another alternative to the embodiment shown in FIG. 1, the methods and apparatus of this invention can deliver pressurized inert gas such as nitrogen, pressurized active gas such as carbon dioxide, or a mixture of gases, directly to bag 5, and to the entire vacuum chamber, without any manifold whatsoever.

Liner bags 5 may be refilled with one, or more than one gas, may be refilled with a mixture of gases, or with different gases from separate sources. For example, some fruits such as strawberries exhibit good shelf life when stored in nitrogen gas mixed with carbon dioxide gas in a low oxygen concentration modified atmosphere. The methods and apparatus of this invention permit the introduction of precisely blended inert gas mixtures with a desired oxygen concentration by volume in each bag.

Figure 6:
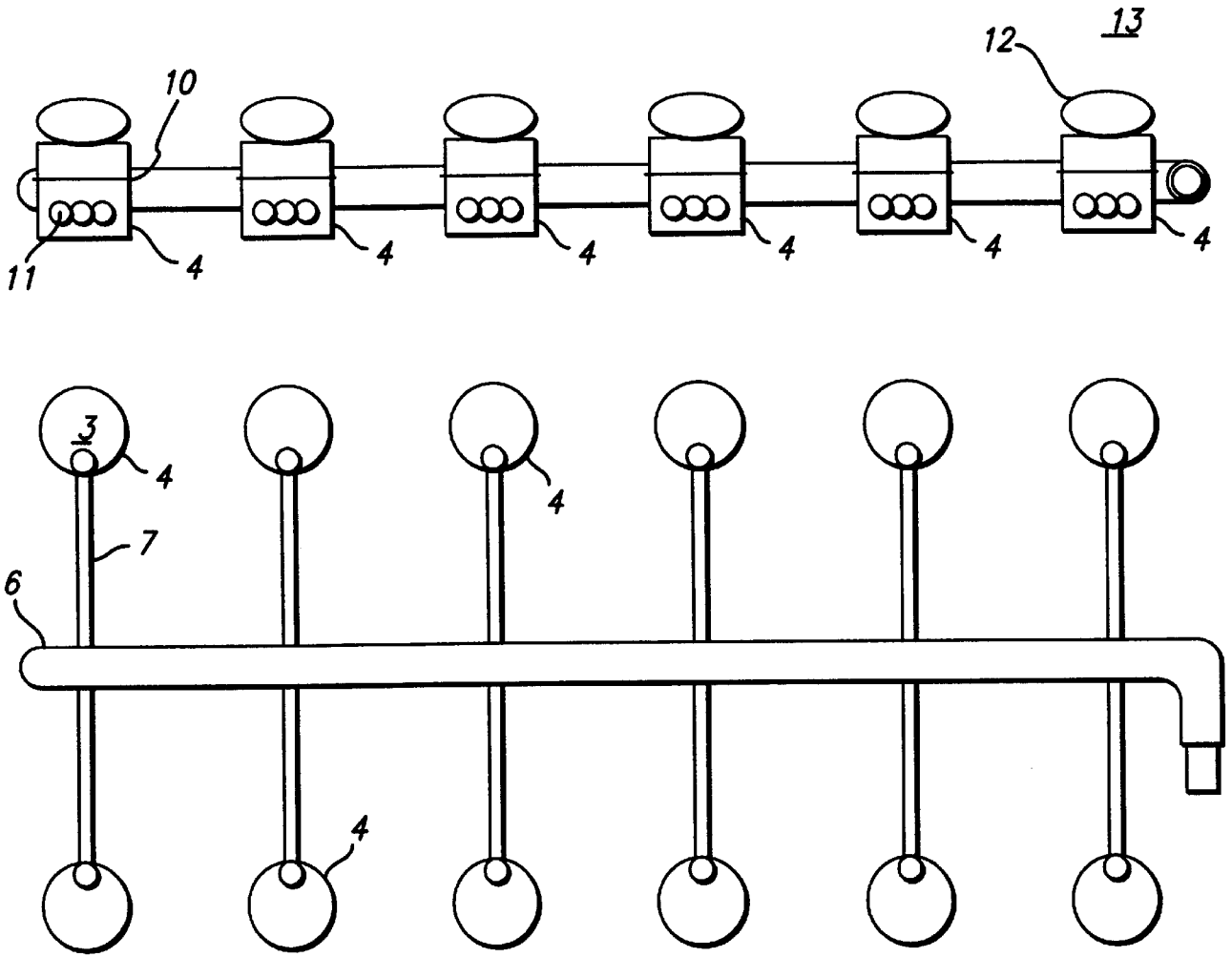
FIG. 6 shows a GFM embodiment including a gas flush hose, nozzle, and tube with its lid in an open position.

FIG. 6 provides side and top views of a plurality of tubes 4 connected to pipe 6 of manifold 2, showing that the methods and apparatus of this invention can modify the atmosphere in a plurality of liner bags of produce simultaneously, reducing costs substantially.

Figure 7:
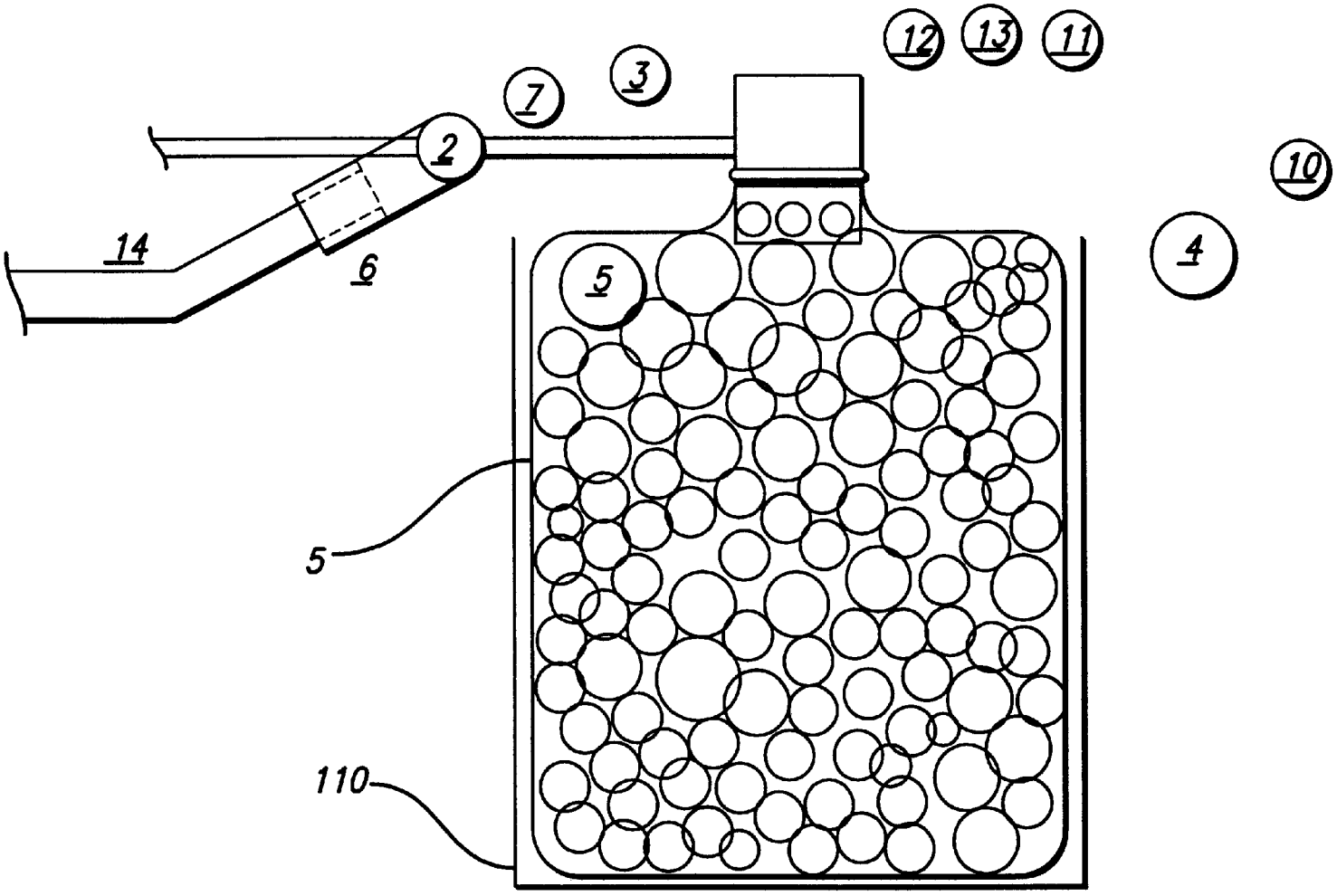
FIG. 7 shows IBFP's with associated GFM tubes attached thereto. A gas flush nozzle and gas flush tube and lid are positioned for inert gas input to the GFM and to the IBFP's as ambient air enters the vacuum chamber of FIG. 1.

FIG. 7 shows, in exploded detail, one of liner bags 5 inside bin 110. FIG. 7 shows the connection of tube 4 to the opening at the top of liner bag 5 by means of a tie holding the opening of liner bag 5 securely to tube ring 10. FIG. 7 also shows the connection of tube 4 and its associate liner bag 5 to manifold 2 through gas flush hose 7 and tube 6.

Figure 8:
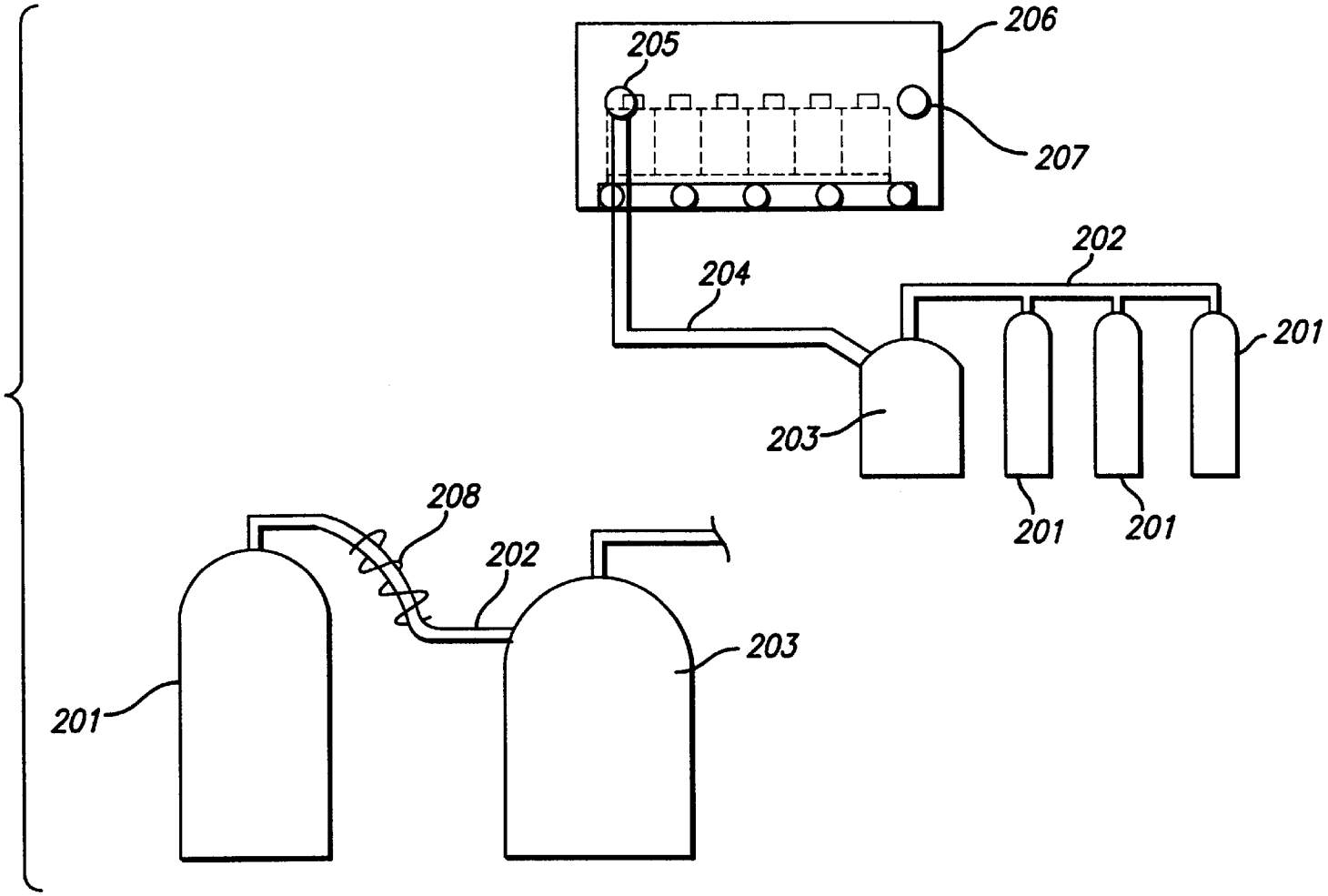
FIG. 8 shows the IGFS of FIG. 1, particularly the input point for various types of inert/active gas.

FIG. 8 shows an alternate embodiment to FIG. 1. Here, liquid nitrogen from tanks 201 pass via line 202 to nitrogen gas accumulator 203. From accumulator 203 nitrogen gas passes via line 204 to manifold 205 through a valve in the wall of vacuum chamber 206. This vacuum chamber includes vacuum release valve 207.

A detailed drawing at the lower left of FIG. 8 shows one embodiment of a connection between nitrogen liquid container 201 and nitrogen gas accumulator 203, including liquid gas expansion coil 208 in line 202.

Figure 9:
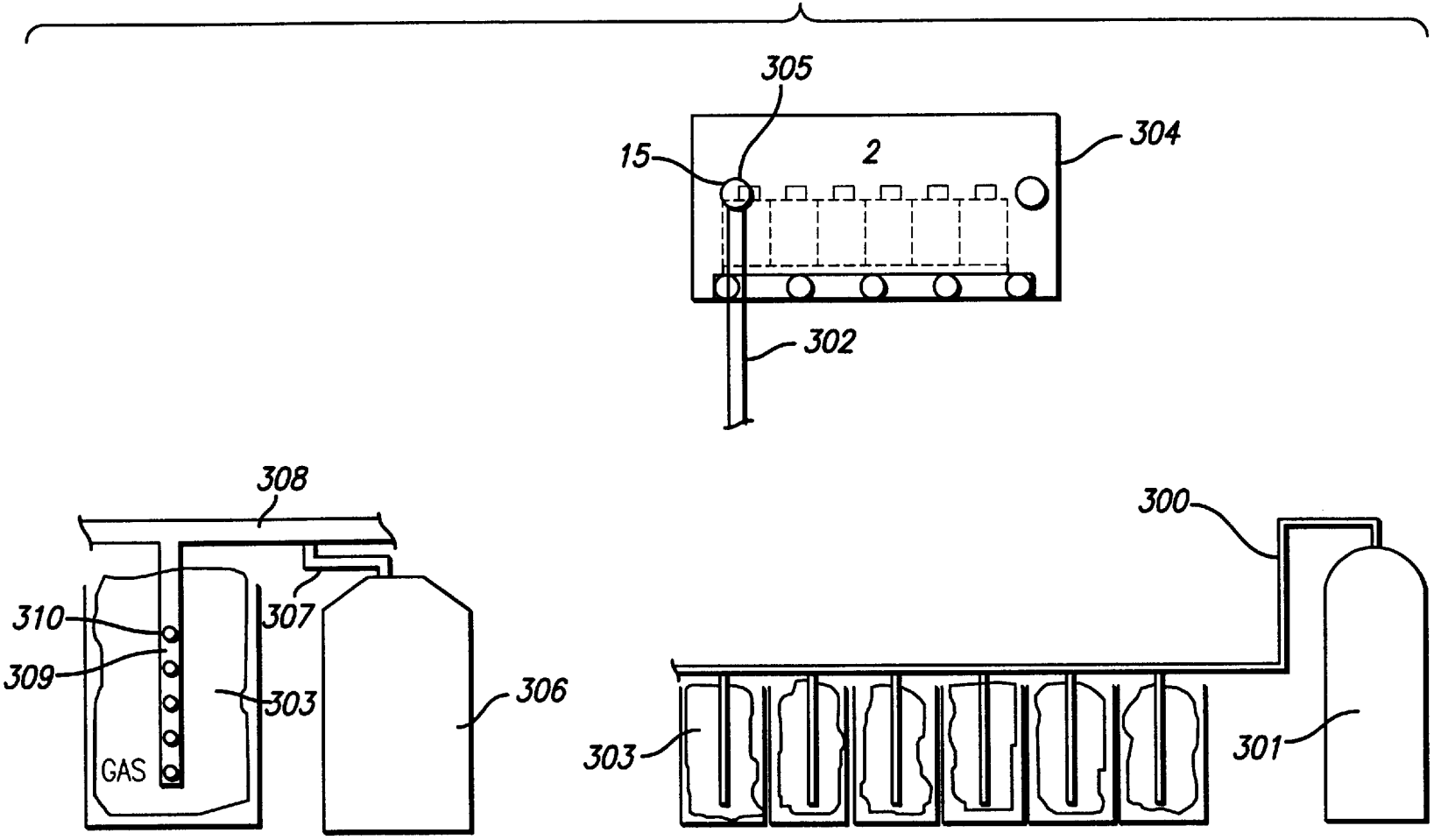
FIG. 9 shows the IGFS of FIG. 1 using nitrogen gas delivered through feed lines, control valves and bladder bags; nitrogen gas is delivered to individual bladder bags from a gas expansion coil and accumulator connected to liquid nitrogen cylinders.

FIG. 9 shows variations of the embodiment illustrated in FIG. 1. In FIG. 9, lower right, liquid nitrogen from tank 301 passes via expansion coils 302 to bladder bags 303. From there, gas in bladder bags 303 is delivered via line 302 to vacuum chamber 304 via line 302 and valve 305. Alternatively, liquid nitrogen can pass from tank 306 via line 307 and 308 to bladder bags 303. Line 308 terminates in tube 309 that has a plurality of hoses 310 to deliver gas into bag 303.

Figure 12:
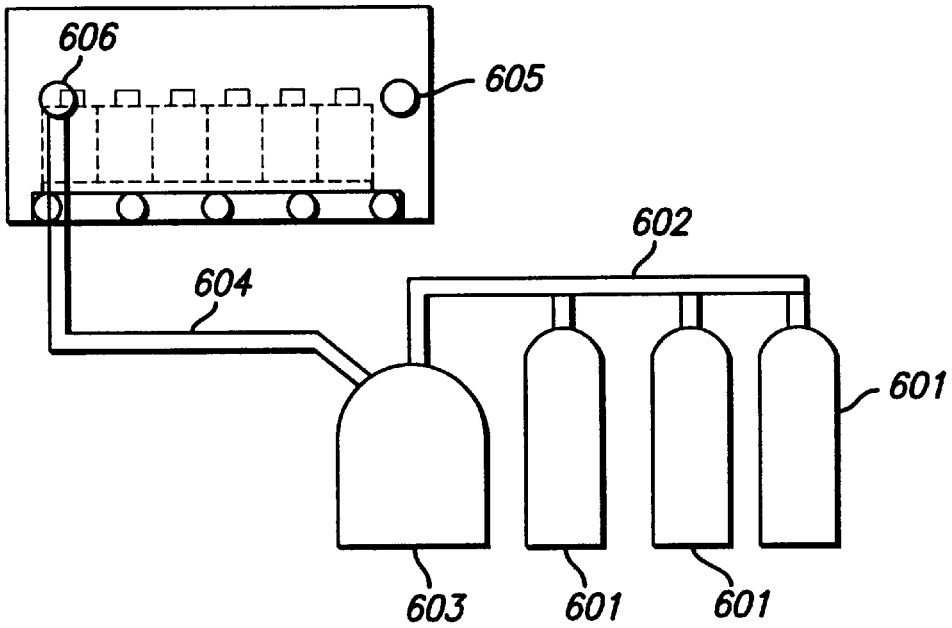
FIG. 12 shows the IGFS of FIG. 1 using nitrogen in gas form delivered directly from an expansion coil and gas accumulator on demand; this gas comes from liquid nitrogen cylinders attached to an expansion coil or coils.
Figure 12:
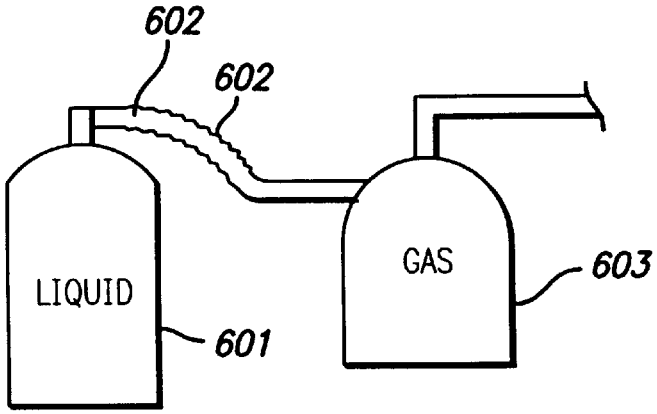
Figure 13:
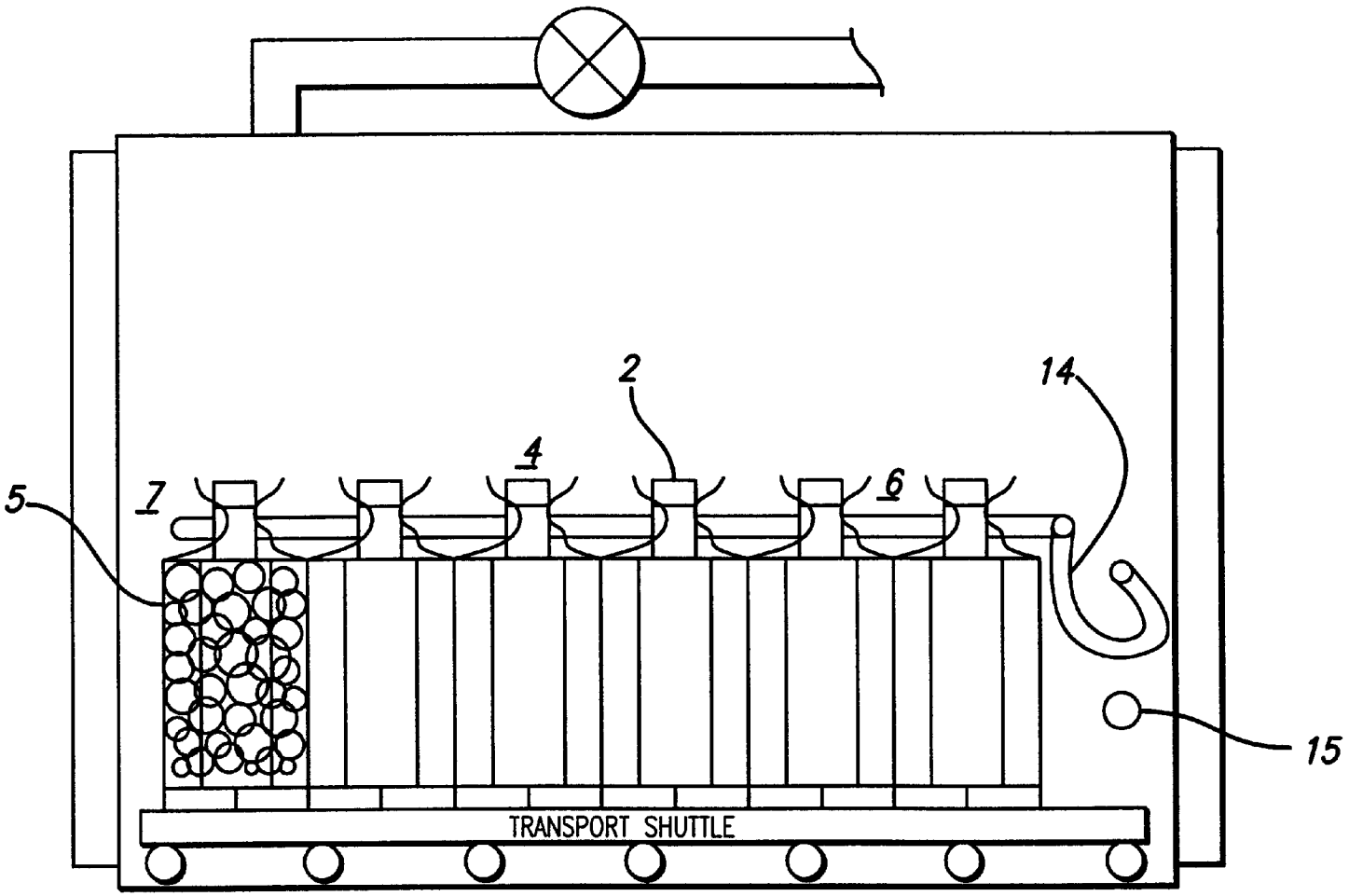
FIG. 13 shows a side view of the vacuum chamber of FIG. 1 with 12 IBFP's in the chamber.

FIGS. 10, 11, and 12 show alternatives to the embodiment of FIG. 1. In FIG. 10, liquid nitrogen passes from tank 404 via expansion coil 405 and line 406 to bag 1. From bag 1, inert gas passes via line 407 to vacuum chamber 408 through valve 409.

In FIG. 11, nitrogen or other inert gas from tank 501 passes through line 502 to vacuum chamber 503 via valve 504.

In FIG. 12, liquid nitrogen from tanks 601 passes via line 602 to inert gas expansion coils 603 and from there, via line 604, the gas passes into vacuum chamber 605 through valve 606. Liquid nitrogen container 603 includes, in line 602, gas expansion coils 602A to convert the liquid to a gas.

What is claimed is:

1. An apparatus for packaging bulk fresh produce, comprising a vacuum chamber free of foam lining; support means for a plurality of bags or other containers for said produce within said vacuum chamber; a valve through the wall of said vacuum chamber for drawing a vacuum within said chamber; means for withdrawing air from said vacuum chamber and from the interior of each of said bags or other containers in said vacuum chamber, including valve means for each of said bags or other containers, each of said valve means being insertable in and removable from said bags or other containers, whereby the pressure inside said chamber and said bag become substantially the same, and means for delivering to said vacuum chamber and to the interior of each of said bags a replacement gas or mixture of gases of desired concentration and nature and at variable, controlled flow rates, while restoring the pressure inside the chamber and inside and outside each of said bags or other containers to ambient pressure at rates sufficient to minimize crushing or bruising of said produce within each of said bags and containers.

2. The apparatus of claim 1 wherein said vacuum chamber is of sufficient size and shape to receive and hold, simulaneously, a plurality or bags of other containers of said produce, said bags or containers together weighing at least about 50 pounds.

3. The apparatus of claim 1 further comprising, external to said vacuum chamber, at least one bag or bladder capable of holding sufficient active or inert gases to replace the gases inside said bags or other containers, and a connecter between said at least one bag or bladder and said means for delivering to said vacuum chamber a replacement gas or mixture of gases of desired concentration and moisture.

4. The apparatus of claim 1 further comprising means for varying the absolute pressure of the vacuum drawn on each bag or container in said vacuum chamber and for controlling the pressure at which refilling of said bags or containers with said active or inert gases takes place.

* * * * *